US006508040B2

(12) United States Patent
Nelson

(10) Patent No.: US 6,508,040 B2
(45) Date of Patent: Jan. 21, 2003

(54) HOLE PATCHING DEVICE AND METHOD OF USE

(76) Inventor: Monte G. Nelson, 160 E. 100 South, American Fork, UT (US) 84003

( * ) Notice: Subject to any disclaimer, the term of this patent is extended or adjusted under 35 U.S.C. 154(b) by 0 days.

(21) Appl. No.: 09/746,239

(22) Filed: Dec. 22, 2000

(65) Prior Publication Data

US 2002/0059767 A1 May 23, 2002

Related U.S. Application Data

(60) Provisional application No. 60/171,842, filed on Dec. 22, 1999.

(51) Int. Cl.[7] ..... E02D 37/00; E04G 23/00

(52) U.S. Cl. ..... 52/514; 52/27; 29/402.09; 29/402.18; 114/227

(58) Field of Search ..... 52/514, 27; 29/402.01, 29/402.09, 402.18, 452.16; 156/94; 264/36; 114/227

(56) References Cited

U.S. PATENT DOCUMENTS 897,932 A * 9/1908 Sampson
2,476,601 A * 7/1949 Sharper
3,325,955 A * 6/1967 Hunt
3,999,347 A * 12/1976 Devlin ..... 52/127
4,075,809 A * 2/1978 Sirkin ..... 52/514
4,100,712 A * 7/1978 Hymann ..... 52/514
4,193,243 A * 3/1980 Tiner ..... 52/514
4,285,183 A * 8/1981 Condit ..... 52/514
4,406,107 A * 9/1983 Schoonbeck ..... 52/514
4,509,243 A * 4/1985 Schneider et al. ..... 29/402.02
5,018,331 A * 5/1991 Forzano ..... 52/514
5,058,519 A * 10/1991 Collins ..... 114/227
5,299,404 A * 4/1994 Jabro ..... 52/514
5,954,095 A * 9/1999 Grigory et al. ..... 138/98
5,983,587 A * 11/1999 Limonad ..... 52/514
6,044,613 A * 4/2000 Crafts et al. ..... 52/741.1
6,317,952 B1 * 11/2001 Vogt ..... 20/402.09

* cited by examiner

*Primary Examiner*—Yvonne M. Horton
(74) *Attorney, Agent, or Firm*—Angenehm Law Firm, Ltd.; N. Paul Friederichs

(57) ABSTRACT

A hole patching device including mechanism for covering an opening on an interior surface of a wall, the covering mechanism being formed of a generally rigid material and being at least two inches in diameter; mechanism for guiding the covering mechanism through the opening, which may include a slit cut from a center of the covering mechanism to an outer edge of the covering mechanism; mechanism for securing the covering mechanism to the interior surface of the wall to define a pocket; an insert for filling the pocket; and a hardenable material spread over the insert and pocket smoothable with the wall and a method of use.

20 Claims, 1 Drawing Sheet

HOLE PATCHING DEVICE AND METHOD OF USE

FIELD OF THE INVENTION

The present invention claims priority from U.S. provisional patent application No. 60/171,842, filed Dec. 22, 1999 and titled HOLE PATCHING DEVICE & METHOD OF USE. The present invention relates to devices for patching holes and more specifically devices for patching holes in a wall.

BACKGROUND OF THE INVENTION

Modern homes generally include wall coverings of plywood, drywall or other such material secured to studs. These materials, while strong, do become damaged typically in the form of a hole. One common method that causes holes is opening a door too far and sending the opposing door knob into and occasionally completely through the adjacent wall. Holes are considered unattractive, unsightly and generally undesired.

Previously, home owners could fix these holes in a couple manners. In one method, the home owner would cut a large square or rectangular block of drywall out of the wall. The block would extend half way across the adjacent wall studs. A new piece of drywall with similar dimensions of the now enlarged opening is cut and secured inside the opening. The wall is then taped and plastered in the manner used in original construction. This method is time consuming, messy and exceeds the abilities of most home owners, requiring the services of a professional.

In an alternate method, a variety of strips of wood are cut with a length longer than the diameter of the opening and a width narrower. The pieces of wood are tied to a string and inserted into the opening. The string is held taught and the wood stripes are fanned out across the back of the hole. The hole is then filed with plaster, smoothed and sanded. This method requires substantial coordination and time and has a poorly secured backside to the now filled hole.

What is needed is a device and method of repairing a hole in a wall that is simplistic enough to allow the average home owner to repair the hole. The process should be fast, solid, requiring a minimum amount of time and talent to accomplish the task with professional results.

SUMMARY

The present invention includes a device for repairing a hole in a wall. The device includes a cover for an opening that secures on an interior surface of a wall. The cover is preferably formed of a generally rigid material and is at least two inches in diameter. The device includes a guide for directing the cover through the opening, which preferably is a slit cut from a center of the cover to an outer edge of the cover. The device further provides a securement mechanism for joining the cover to the interior surface of the wall, where it together with the edges of the hole defines a pocket. An insert is placed in the pocket to substantially fill the same. A hardenable material, such as plaster, spreads over the insert and pocket, where it is smoothed with the wall.

This device may have additional components that augment the invention. For instance, the securement mechanism may include a temporary and a permanent portion. Temporary securement may be done with a t-bar together with a wedge or a cord and stop. These hold the cover to the wall while adhesive permanently attaches the cover to the wall. Once permanent securement is complete the temporary securement portions may be removed in whole or in part. The wedge may be designed to include a cutting edge, e.g., saw for cutting smooth edges to the hole and other modifications are made apparent with the description herein.

The present invention also includes a method of repairing a hole. The inventive steps include guiding a cover through an opening using a slit extending from a center of the cover to an outer edge of the cover. This may be done in a cork screw type manner. Next, one secures the cover to an interior surface of a wall to define a pocket. The pocket does not need to be filled with plaster, which tends to shrink upon drying. Instead, one may insert a plug to substantially fill the pocket and then apply a hardenable material over the insert and pocket such as plaster. This process may be augmented with other steps, which may for instance include adhesively securing the cover to the interior surface of the wall. Additionally, the cover may be temporarily secured to the interior of the wall using a t-bar and wedge.

DETAILED DESCRIPTION

Figure 1:
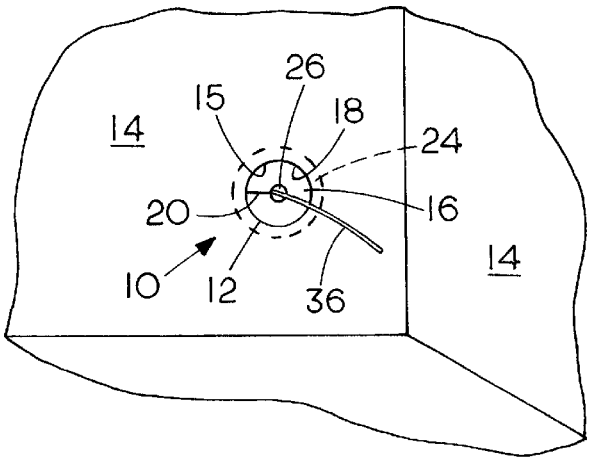
FIG. 1 shows the present invention installed on a wall.
Figure 3:
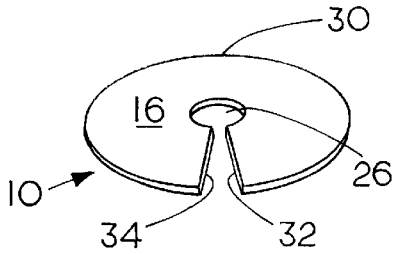
FIG. 3 shows the covering mechanism.
Figure 2:
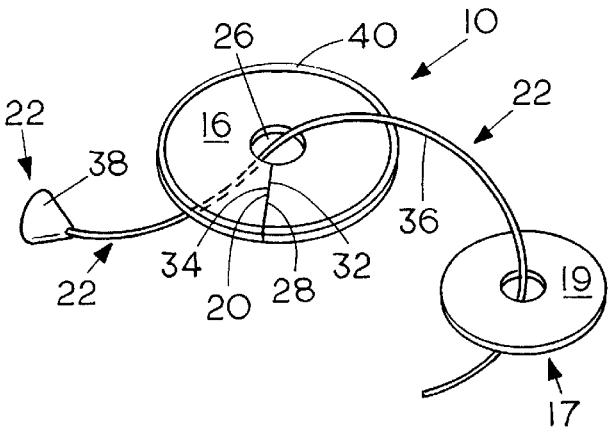
FIG. 2 shows an embodiment of the present invention.
Figure 4:
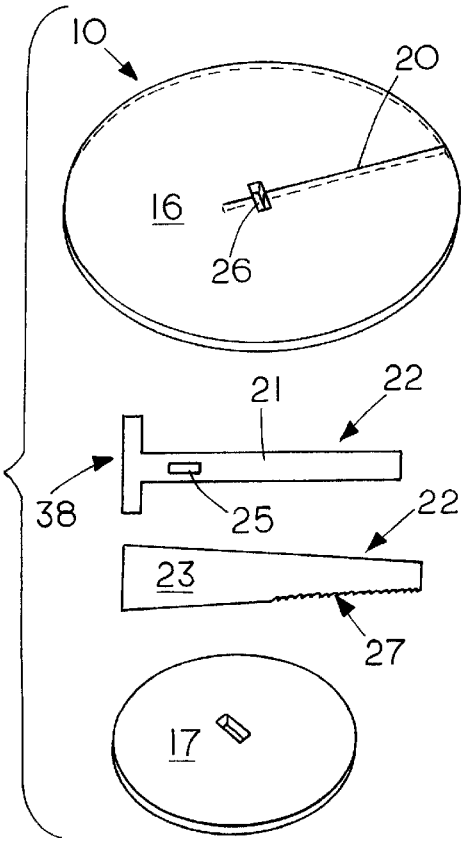
FIG. 4 shows the preferred embodiment of the present invention.

The present invention 10, shown in FIGS. 1–4, is the preferred embodiment of the present invention. The present invention is preferably for the purpose of patching holes 12 in walls 14, such as drywall, although one using the drawings and description can easily find many other uses for the present invention. Hole 12 and opening 12 are used interchangably throughout the specification with both referencing a hole through a wall. The present invention 10 may include, mechanism 16 for covering the opening 12 on an interior surface 18 of the wall 14, mechanism 20 for guiding the covering mechanism 16 through the opening 12, and mechanism 22 for securing the covering mechanism 16 to the interior surface 18 of the wall 14, creating a pocket 15 and mechanism 17 for filling the pocket 15. Each mechanism and the operation,is described further below.

The covering mechanism 16 may be any size or shape suitable for substantially covering the opening 12 in the wall 14. Small gaps may be present, the size of which need to be small enough to allow effective plastering of the covered hole 12 as described in the operation section below. The preferred shape of the covering mechanism is circular as this is believed to be the most common shape of a hole 12 in a wall 14.

The covering mechanism 16 preferably may cover holes 12 that are an inch in diameter to the size of the largest holes. Commonly holes 12 range from about 3 inches to about 5 inches in diameter, although larger and smaller holes are found. The covering mechanism preferably is about two or more inches in diameter larger than the opening 12 such that at least a one inch perimeter 24 (FIG. 1) is obtained around the circumference of the holes 12, although a smaller perimeter 24 may be used. The perimeter 24 prevents the covering mechanism 16 from being pulled back through the opening 12.

The covering mechanism 16 may be formed of any sufficiently rigid material for the purpose intended. The material needs to provide a firm surface without substantial bowing into the opening, but preferably provides some flexibility for working the covering mechanism 16 through the opening 12. Suitable materials include, metals, substantially rigid plastics, substantially rigid elastomers, wood, ceramic, and any other substantially rigid material. The preferred material for the covering mechanism 16 is a substantially rigid plastic due to its cost and ease of use.

The guiding mechanism 20 may be any mode of changing the size of the profile of the covering mechanism 16 without damaging the covering mechanism 16. The preferred mode, shown best in FIG. 1, includes an opening 26 defined in the approximate center of the changing mechanism 16 and a cut 28, extending from the hole 26 to the outer edge 30 of the changing mechanism 16. When the opposing edges 32, 34 are spread, one can plainly see that the profile of the changing mechanism can be corkscrewed through an opening that is approximately the size to the width of the changing mechanism, preferably a half inch or less, by approximately half the diameter of the changing mechanism 16.

The securing mechanism 22 may include string or other cord-like material 36 and stop 38. Preferably, the securing mechanism 22 is a t-bar 21 with or without a wedge 23. The wedge 23 passes through slot 25 of the t-bar 21 and biases against the edges of the opening to be filled to draw the covering mechanism 16 tight against the wall 14. The wedge 23 may have a serrated edge 27 for cutting a clean opening in the wall 14.

The stop 38 is preferably of a size larger than the opening 26 such that when the string 36 is pulled through the opening 26 the stop will brace against the perimeter of the opening 26. The opening 26 may be of any suitable size, but is preferably about one inch in diameter. The stop may be of any size or shape so long as it secures against the perimeter of the opening 26 and does not extend beyond the outer surface of the wall 14 and into the room. The string 36 and stop 38 combination also provides a mechanism for retrieving the, invention 10 should it drop down inside the wall 14. The mechanism 22 may further include a ring of adhesive 40 for adhering the covering mechanism 16 to an interior surface of a wall 14. The securing mechanism 22 holds the covering mechanism 16 in position covering the opening 12, creating a pocket 15 between the covering mechanism 16 and the sides of the opening 12.

The opening 12 in a preferred embodiment is a circular or other common shape. The circle may be drawn on the exterior surface of the wall 14 with a stencil and then cut with a keyhole saw, serrated edge 27 of the wedge 23 or like implement. A filling mechanism 17 may then be positioned to substantially fill the pocket 15. The filing mechanism 17 may be any material which substantially fills and does not require substantial drying or hardening time. While various foams could be used, the preferred filling mechanism 17 is a plug 19 formed of preformed foam, wood or other solid material. Once the filling mechanism 17 is in place, the installer may cover the hole with plaster and paint.

In operation, the opening 12 may be widened into a circular or other common shape, perhaps through a stencil and cutting process. The cutting may be done with the serrated edge 27 of the wedge 23. The string 36 or t-bar 21 is fed through the opening 26 of the covering mechanism 16 for later use. The covering mechanism 16 is spread along the guiding mechanism 20, changing the profile of the covering mechanism 16 to a dimension smaller than the opening 12. The configuration is similar to the letter "c" twisted along its central axis. An opposing edge 32 or 34 is fed through the opening 12. The covering mechanism 16 may then be corkscrewed into the wall 14. Once inside, the installer manipulates the string 36 or t-bar 21 and stop 38 combination to hold the covering mechanism 16 in a desired location. Adhesive 40 may be uncovered (if preapplied) or applied to further provide securement of the covering mechanism 16 about the opening 12 on the interior surface of the wall 14. The best adhesive 40 which has been found is sold under the trade name "Liquid Names," due to the absorption of the adhesive 40 prior to the adhesive 40 setting up. A wedge 23 may be fed through slot 25 in the t-bar 21 and biased against the wall 14 to secure the covering mechanism 16 in place while the adhesive dries. Screws or other fasteners may also be used to hold the covering mechanism 16 in place.

The wedge 23 may be removed and t-bar 21 may be broken, pushed into the interior wall or otherwise vacated, when the adhesive or other permanent fastener has taken hold, assuming a wedge 23 and t-bar 21 were used. This configuration defines a pocket 15 between the edges of the hole 12 in the wall 14 and the covering mechanism 16. The pocket 15 is filled with a plug 19, plaster, wood filler, putty, other filling material or combination thereof. The string 36, no longer needed, may be clipped, the filler material smoothed and the wall 14 painted or otherwise decorated.

It will be appreciated that the foregoing description of the preferred embodiment of the invention is presented by way of illustration only, and not by way of any limitation. It should be noted that use of appropriate materials would allow the present invention to be used for patching of holes in automobile walls and automotive bumper walls or other areas. Various alternatives and modifications may therefore be made to the above mentioned and illustrated embodiments without departing from the spirit and scope of the present invention.

I claim:

1. A hole patching device comprising:

means for covering an opening on an interior surface of a wall, the covering means being formed of a generally rigid material, the covering means being at least two inches in diameter;

means for guiding the covering means through the opening, the guiding means comprising a slit cut from a center of the covering means to an outer edge of the covering means;

means for securing the covering means to the interior surface of the wall to define a pocket;

an insert for filling the pocket; and a hardenable material spread over the insert and pocket smoothable with the wall.

2. The device of claim 1 wherein the securing means further comprises a t-bar.

3. The device of claim 2 wherein the securing means further comprises a wedge, the wedge interacting with the t-bar.

4. The device of claim 3 wherein the wedge further comprises a cutting tool.

5. The device of claim 4 wherein the cutting tool is a saw.

6. The device of claim 1 wherein the securing means comprises a cord attached to a stop.

7. The device of claim 1 wherein the means for securing further comprises adhesive.

8. The device of claim 1 wherein the securing means is part temporary and part permanent.

9. A hole patching device comprising:

means for covering an opening on an interior surface of a wall;

means for guiding the covering means through the opening, the guiding means comprising a slit cut from a center of the covering means to an outer edge of the covering means;

means for securing the covering means to the interior surface of the wall to define a pocket;

an insert for filling the pocket; and a hardenable material spread over the insert and pocket smoothable with the wall.

10. The device of claim 9 wherein the securing means further comprises a t-bar.

11. The device of claim 10 wherein the securing means further comprises a wedge, the wedge interacting with the t-bar.

12. The device of claim 11 wherein the wedge further comprises a cutting tool.

13. The device of claim 12 wherein the cutting tool is a saw.

14. The device of claim 9 wherein the securing means comprises a cord attached to a stop.

15. The device of claim 9 wherein the means for securing further comprises adhesive.

16. The device of claim 9 wherein the securing means is part temporary and part permanent.

17. The device of claim 9 wherein the covering means is formed of a generally rigid material and is at least two inches in diameter

18. A method of repairing a hole comprising the steps of:

guiding a cover through an opening using a slit extending from a center of the cover to an outer edge of the cover;

securing the cover to an interior surface of a wall to define a pocket;

inserting a plug to substantially fill the pocket; and applying a hardenable material over the insert and pocket.

19. The method of claim 18 further comprising the step of:

adhesively securing the cover to the interior surface of the wall.

20. The method of claim 18 further comprising the step of:

temporarily securing the cover to the interior of the wall using a t-bar and wedge.

* * * * *